US005259217A

United States Patent [19]

Civanelli et al.

[11] Patent Number: 5,259,217

[45] Date of Patent: Nov. 9, 1993

[54] DEVICE FOR DETERMINING THE TYPE OF CONSTITUENT FABRIC OF A LOAD OR CLOTHES TO BE WASHED IN A WASHING MACHINE OR THE LIKE

[75] Inventors: Claudio Civanelli, Travedano Monate; Raffaele Paganini, Varese, both of Italy

[73] Assignee: Whirlpool International B.V., Veldhoven, Netherlands

[21] Appl. No.: 774,765

[22] Filed: Oct. 9, 1991

[30] Foreign Application Priority Data

Oct. 29, 1990 [IT] Italy ..... 21902 A/90

[51] Int. Cl.[5] ..... D06F 33/02

[52] U.S. Cl. ..... 68/12.04; 68/12.02; 68/12.12

[58] Field of Search ..... 68/12.01, 12.02, 12.04, 68/12.12

[56] References Cited

U.S. PATENT DOCUMENTS 4,400,838 8/1983 Steers et al. ..... 68/12.01 X
5,144,819 9/1992 Hiyama et al. ..... 68/12.04

FOREIGN PATENT DOCUMENTS 2559796 8/1985 France ..... 68/12.01

*Primary Examiner*—Philip R. Coe
*Attorney, Agent, or Firm*—Thomas E. Turcotte; Stephen D. Krefman; Thomas J. Roth

[57] ABSTRACT

A clothes washing machine comprising a device for determining the weight of a clothes load placed in the washing machine drum, a microprocessor circuit control and memory for controlling the operation of the motor for the washing machine such as to cause the drum to spin; for measuring the quantity of water remaining in the clothes load after spinning; for determining the type of constituent fabric of the clothes load, based on the quantity of water remaining in the clothes; and for operating the washing machine in accordance with the determined fabric type.

15 Claims, 2 Drawing Sheets

DEVICE FOR DETERMINING THE TYPE OF CONSTITUENT FABRIC OF A LOAD OR CLOTHES TO BE WASHED IN A WASHING MACHINE OR THE LIKE

DESCRIPTION

This invention relates to a method and device for determining the type of constituent fabric of the clothes or load inserted for washing purposes into a washing machine or the like of the type comprising a housing containing a tub in which a drum is rotated in known manner by an electric motor.

Various devices are known for determining the weight of the load contained in a washing machine.

These devices enable said machineto be suitably operated, for example by appropriately feeding water and detergent into it. Known devices do not however enable the wash temperature to be automatically chosen because this temperature (for a given wash program) depends mainly on the constituent fabric of the clothes and has to be set by the user in accordance with the load fed into the drum for washing.

Consequently, if the load is of delicate fabric the wash is done at relatively low temperature, whereas if the fabric is heat-resistant the wash can be done at higher temperature (60°-90° C.). In all cases, the temperature is selected manually. This means that the load can be damaged if the user selects the wrong water temperature.

An object of the invention is therefore to provide a clothes washing machine in which the type of constituent fabric of the clothes to be washed can be determined in the washing machine or the like of the aforesaid type, the wash then being appropriately carried out on the basis of this determination.

A further object of the invention is to provide a clothes washing device which is of simple construction and low cost.

A further object of the invention is to provide a device of the aforesaid type which is reliable and can be used on already known washing machines in which the weight of the load to be washed can be determined.

These and further objects which will be apparent to the expert of the art are attained by a method for determining the type of constituent fabric of the clothes to be washed in a washing machine or the like of the aforesaid type, characterized by placing a known weight of clothes in the drum and then feeding a quantity of water into the tube so that it becomes absorbed by said clothes or load, then rotating the drum at a speed at least equal to the spinning speed for a predetermined time and expelling the water not retained by said load from the machine, and finally evaluating the quantity of water remaining in the clothes, the result of this evaluation being compared with predetermined values to define the type of constituent fabric of the load on the basis of said comparison and thus determine its wash criteria.

Said method is implemented by a device incorporated in a washing machine or the like of the aforesaid type, characterized by comprising control means for causing the motor to rotate the drum at a speed at least equal to the spinning speed for a predetermined period prior to the clothes wash stages, measurement means for determining the quantity of water remaining in the clothes after spinning, and comparison means for comparing the data obtained by the measurement means with predetermined data on the water absorption capacity of the various fabrics, said comparison means determining the type of constituent fabric of the load and advantageously defining the criteris for its wash.

The present invention will be more apparent from the accompanying drawing, which is provided by way of non-limiting example and in which.

Figure 1:
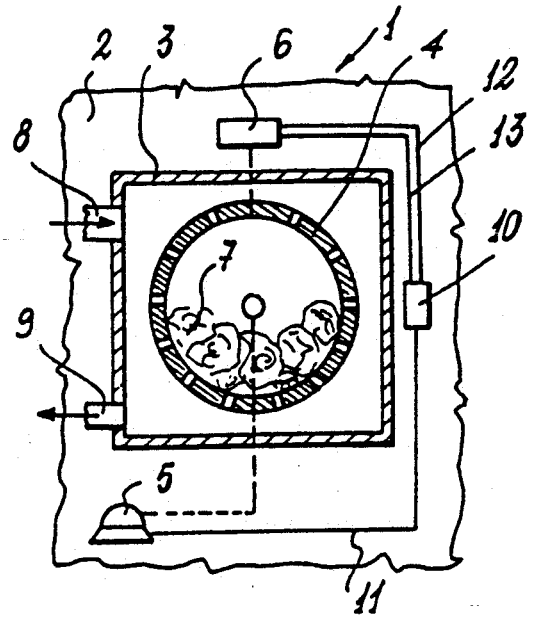
FIG. 1 is a schematic sectional view of a washing machine constructed in accordance with the invention.
Figure 2:
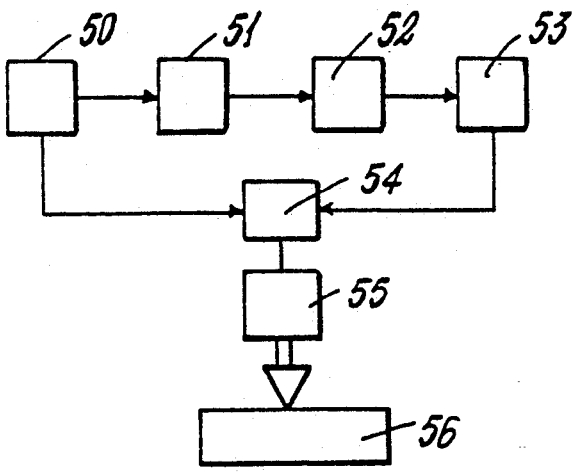
FIG. 2 is a block diagram showing the various steps in the method of the invention.
Figure 3:
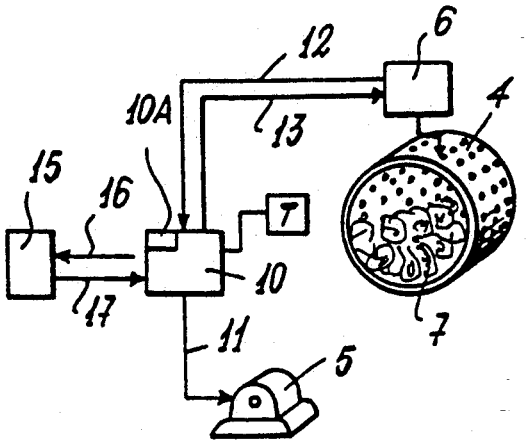
FIG. 3 is a schematic view of a device according to the invention.

With reference to FIGS. 1 to 3, a washing machine 1 comprises a housing 2 containing a tub 3 in which a drum 4 rotates. The drum is driven by an electric motor 5 in known manner. The machine 1 is also provided with means 6, of known type and therefore only schematically represented, for determining the weight of a load or clothes 7 placed in the drum 4. These known means 6 can be of mechanical type or be of the type described and represented in another patent application in the name of the present assignee, Italian patent Ser. No. 31,923, filed Nov. 29, 1990 (WHI-90-026) in which the weight of the load 7 is determined by determining the work done by the motor 5 in rotating the drum 4 at two different speeds, the lower speed being at least equal to the drum adherence speed.

The tub 3 is connected to two usual pipes 8 and 9 for water feed to and discharge from the washing machine respectively. Other usual members for detergent distribution and water circulation (pump) are also provided (but not shown). According to the invention the machine 1 comprises a device for determining the constituent fabric of the clothes 7 and incorporating a control unit 10, advantageously with a microprocessor circuit, for operating on the motor 5 and in dialogue with the means 6 for determining the weight of the said load. For this purpose the microprocessor unit or circuit 10 is connected to the motor 5 via a branch 11 and to the means 6 via branches 12 and 13 (input and output of said unit). The unit is also connected to the usual timer T and to the other usual components (not shown) of the machine 1 required for its operation.

The microprocessor unit or circuit 10 also cooperates with a memory member 15 via an input branch 16 and an output branch 17 thereof.

The method of the invention is described hereinafter in relation to the operation of said device with reference to FIG. 2. On placing the clothes 7 in the drum 4 and following the start of the machine 1, the means 6 determine the weight of said load in known manner. This determination is indicated by the block 50 in FIG. 1.

The determined weight is fed to the unit 10 via the branch 12 and is memorized in a suitable memory cell 10A of the unit 10. Following this, the unit 10 operates on the washing machine timer T to cause water to be fed into the tub 3 via the pipe 8. This step of the method according to the invention is indicated by the block 51 in FIG. 2.

After a suitable quantity of water has been fed into said tub (advantageously, this quantity is proportional to the measured weight of the load 7), the unit 10 via the branch 11 causes the motor 5 to rotate the drum 4 at the spinning speed. This step, indicated by the block 52 in FIG. 2, lasts for at least six seconds.

After spinning, the drum 4 stops and the unit 10 causes the timer to discharge the water present in the tub 3, said discharge taking place via the pipe 9. This step is indicated by the block 53 in FIG. 2.

It should be noted that the quantity of discharged water is not equal to the quantity fed into the tub 4 because part of the water is absorbed by the clothes 7.

At this point the means 6 (enabled by the unit 10 via the branch 13) make a second determination of the weight of the clothes 7. The new determined value is greater than the value determined in the step 50 because, as stated, the load 7 has absorbed part of the water fed into the machine during the step 51.

In FIG. 2 the new determination of the load weight is defined by the block 54.

The new determined weight is fed to the unit 10 via the branch 12. This microprocessor unit or circuit compares the new weight with that stored in the memory cell (or simply memory) 10A. Using a comparison algorithm, the microprocessor circuit 10 calculates the water remaining in the clothes 7 as a percentage of the water which had entered the machine during the step 51.

Said comparison is made during a step in the method of the invention defined by the block 54 in FIG. 2.

After the percentage of water absorbed by the load has been determined during the step 54, the microprocessor unit or circuit 10 reads the data in the memory 15 via the branch 16.

The data contained in the memory 15 relates to the percentage water absorption by different fabrics which have undergone spinning.

In this respect, it is well known that different types of fabric (cotton, wool, silk) when immersed in water and then spin-dried retain very different percentages of water, for a given drum rotational speed during spinning and for a given spinning time. As stated, the memory 15 contains data relative to the different water absorption capacities of the various fabrics (cotton, wool, silk, synthetic fabrics, etc.).

Consequently the unit 10 read the various data present in said memory and compares them with that obtained during the described step 54. When the value determined during that step coincides with a value present in the memory 15 (or falls between values present therein), the microprocessor circuit 10 reads the corresponding type of fabric in the memory 15 (this step indicated by the block 55 in FIG. 2).

Following this, the circuit using a known comparison algorithm determines a suitable preferred wash program for the type of fabric determined (this step indicated by the block 56 in FIG. 2).

It should be noted that if the load 7 is composed of different fabrics, the value determined during the step 54 is an average absorption value which does not correspond to any fabric. This value tells the circuit 10 that the load 7 is made up of different fabrics, the circuit then defining the load as being constituted of the most delicate fabric. On this basis the unit 10 by means of the timer T selects a wash program (in step 56) such as not to damage the most delicate fabric present in the clothes contained in the drum 4.

Figure 4:
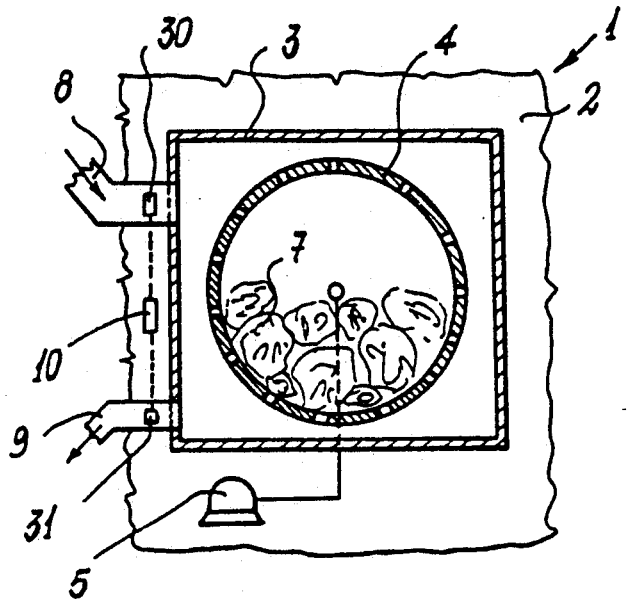
FIG. 4 is a view similar to that of FIG. 1 but showing a different embodiment of the invention.
Figure 5:
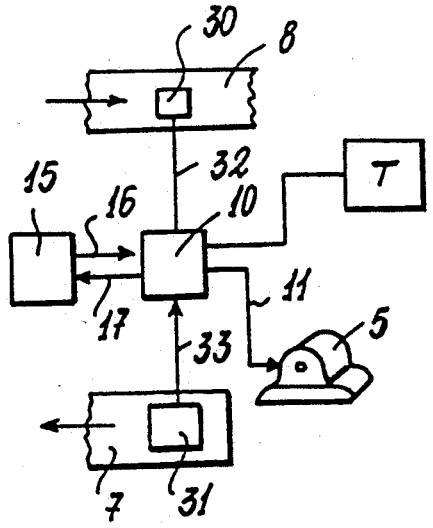
FIG. 5 is a schematic representation of a further embodiment of the invention.

FIGS. 4 and 5 show a different embodiment of the invention. In these figures, parts corresponding to those of the previously described figures are indicated by the same reference numerals. In FIGS. 4 and 5, the microprocessor unit 10 is connected to flow meters 30, 31 of known type. The meters 30, 31 are located in the pipes 8 and 9 and are connected to said unit via 32 and 33 respectively.

The use of the device of FIGS. 4 and 5 and the implementation of the method of the invention differ from those described in relation to FIGS. 1 to 3 in that the load is not weighed. With the described device, when the machine 1 is started water is immediately drawn into the tube 3 in known manner through the pipe 8. The water quantity fed into the tub is measured by the meter 30.

After a suitable period during which the clothes 7 absorb said water (about 10–20 seconds), the drum 4 is rotated at spinning speed in the manner already described. The water is then discharged from the tub 3 and its quantity is measured by the flow meter 31 positioned in the discharge pipe 9. This meter and the meter 30 feed their data to the unit 10, which using a comparison algorithm compares the water quantity entering the tub with that leaving, to obtain the percentage ratio. The unit 10 therefore computes the percentage of the water entering the tub 3 which is absorbed by the clothes 7.

At this point the microprocessor unit or circuit 10 reads the data present in the memory 15 and on the basis of this reading determines the type of constituent fabric of the load 7 (in the same manner as that described in relation to FIGS. 1, 2 and 3, to which reference should be made).

It should be noted that in both described embodiments of the method according to the invention, after water has been fed into the tub 3 and has been absorbed by the clothes 7, at least part of the remaining (unabsorbed) water in the tube is discharged. This takes place in accordance with the well known procedures in the washing machine and similar fields.

The meter 31 then feeds data relative to the water discharged before and after spinning to the unit 10, which adds them together in accordance with a known algorithm.

Thus the percentage of the water fed into the tub which is absorbed by the load is obtained by comparing the water quantity fed into the tub with the total water quantity discharged, ie before and after spinning.

The method according to the invention enables the constituent fabric of the clothes undergoing washing to be precisely defined, so that they can be washed totally automatically without the need for manually selecting the wash temperature or the preferred program (eg. for delicate or non-delicate fabrics).

The device of the invention is of reliable operation and low cost.

We claim:

1. A clothes washing machine of the type comprising a housing containing a tub in which a drum is rotated by an electric motor and including means for introducing water into the drum, characterized by control means for causing the motor to rotate the drum at a speed at least equal to the spinning speed for a predetermined period prior to the wash stages of a clothes load, measurement means for determining the quantity of water remaining in the fabrics of the clothes load after said drum rotation, and comparison means for comparing the quantity of water remaining in the clothes load obtained by the measurement means with predetermined information on the water absorption capacity of the various fabrics which may be within the clothes load, thereby to determine the type of constituent fabric of the load for operation of the washing machine in accordance with the determined fabric type.

2. A washing machine as claimed in claim 1, characterized in that the control means are a control unit of the microprocessor type.

3. A washing machine as claimed in claim 2, characterized in that the microprocessor unit also acts as comparison means.

4. A washing machine as claimed in claim 3, characterized in that the control unit is connected to the measurement means.

5. A washing machine as claimed in claim 2, characterized in that the control unit cooperates with a memory containing data on the various absorption capacities of the different fabrics.

6. A washing machine as claimed in claim 2, characterized in that the control unit is connected to the measurement means.

7. A washing machine as claimed in claim 2, characterized in that the washing machine includes a timer, and the control unit is connected to the timer of the washing machine.

8. A washing machine as claimed in claim 1, characterized in that the measurement means are known means for determining the weight of the load contained in the drum.

9. A washing machine as claimed in claim 8, characterized in that the control unit is connected to the measurement means.

10. A washing machine as claimed in claim 1, characterized in that the measurement means are meters for measuring the passing water quantity, said meters being located in pipes for the feed and discharge of water to and from the tub.

11. A washing machine as claimed in claim 10, characterized in that the meters are flow meters.

12. A washing machine as claimed in claim 11, characterized in that the control unit is connected to the measurement means.

13. A washing machine as claimed in claim 10, characterized in that the control unit is connected to the measurement means.

14. A washing machine as claimed in claim 1, characterized in that the control means comprises a memory which memorizes the data determined by the measurement means before spinning of the drum.

15. A washing machine as claimed in claim 1, characterized in that the predetermined period for rotating the drum is at least six seconds long.

* * * * *